US008823624B2

(12) United States Patent
Liu et al.

(10) Patent No.: US 8,823,624 B2
(45) Date of Patent: Sep. 2, 2014

(54) DISPLAY DEVICE HAVING MEMORY IN PIXELS

(75) Inventors: Yu-Jung Liu, Hsinchu (TW); Yu-Hsuan Li, Hsinchu (TW); Chung-Chun Chen, Hsinchu (TW); Chun-Hung Kuo, Hsinchu (TW); Chun-Huai Li, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 1055 days.

(21) Appl. No.: 12/856,228

(22) Filed: Aug. 13, 2010

(65) Prior Publication Data

US 2012/0038604 A1 Feb. 16, 2012

(51) Int. Cl.
*G09G 3/36* (2006.01)

(52) U.S. Cl.
CPC ..... *G09G 3/3648* (2013.01); *G09G 2300/0842* (2013.01); *G09G 2330/022* (2013.01); *G09G 2310/04* (2013.01); *G09G 3/3659* (2013.01); *G09G 2340/0428* (2013.01)
USPC ..... 345/98; 345/204

(58) Field of Classification Search
USPC ..... 345/87–104
See application file for complete search history.

(56) References Cited

U.S. PATENT DOCUMENTS

| | | | | |
|---|---|---|---|---|
| 5,945,972 | A | 8/1999 | Okumura et al. | |
| 5,952,991 | A | 9/1999 | Akiyama | |
| 6,778,162 | B2 | 8/2004 | Kimura et al. | |
| 7,286,192 | B2 | 10/2007 | Lin et al. | |
| 7,567,312 | B2 | 7/2009 | Lin et al. | |
| 8,400,388 | B2 * | 3/2013 | Kim | 345/98 |
| 2002/0075205 | A1 | 6/2002 | Kimura et al. | |
| 2004/0130543 | A1 | 7/2004 | Sun | |
| 2006/0187385 | A1 * | 8/2006 | Liao et al. | 349/114 |
| 2008/0088552 | A1 | 4/2008 | Toya | |

FOREIGN PATENT DOCUMENTS

| | | | |
|---|---|---|---|
| CN | 1800930 | A | 7/2006 |
| EP | 1213701 | A2 | 6/2002 |
| TW | 548625 | B | 8/2003 |

* cited by examiner

*Primary Examiner* — Sumati Lefkowitz
*Assistant Examiner* — Jose Soto Lopez
(74) *Attorney, Agent, or Firm* — Tim Tingkang Xia, Esq.; Morris Manning & Martin, LLP

(57) ABSTRACT

The present invention relates to a memory circuit integrated in each pixel of a display device includes a switching circuit and a memory unit. The switching circuit includes a first transistor having a gate configured to receive a switching control signal, a source and a drain electrically coupled to a liquid crystal capacitor of the pixel, and a second transistor having a gate configured to receive a switching control signal, a source electrically coupled to a storage capacitor of the pixel, and a drain electrically coupled to the liquid crystal capacitor. The memory unit is electrically coupled between the source of first transistor and the storage capacitor. The switching control signal is configured such that in the normal mode, the first transistor is turned off, while the second transistor is turned on, so that the storage capacitor is electrically coupled to the liquid crystal capacitor in parallel and the memory unit is bypassed, and in the still mode, the first transistor is turned on, while the second transistor is turned off, so that the storage capacitor controls the memory unit to supply a stored data to the liquid crystal capacitor.

21 Claims, 7 Drawing Sheets

DISPLAY DEVICE HAVING MEMORY IN PIXELS

FIELD OF THE INVENTION

The present invention relates generally to a display, and more particularly to a display device having each pixel integrated with a memory circuit.

BACKGROUND OF THE INVENTION

Multifunctional portable devices have found widespread applications in a variety of fields. For example, most of mobile phones available in the market integrate a multimedia player, wireless Internet and personal navigation functions. As the technology advances, the size of the display panel of a mobile phone becomes bigger and bigger, and the resolution of the display panel of the mobile phone becomes higher and higher. Accordingly, the power consumption of the mobile phone increases dramatically, where the display panel usually contributes a large portion of the power consumption. Since such a mobile phone generally adopts a battery-driven type, low power consumption is imperative.

It would gain a great deal of relevance if the power consumption during standby periods could be reduced or the IC fresh frequency for a still/static image could be reduced without compromising the display quality of the image. Currently, an electrophoresis-type E-book or a cholesterol-type liquid crystal display (LCD) in a still image display mode consume extremely low power, because of the memory functionality of the pixels after data is written in and no need of image refreshing. However, because of dynamic images and poor color saturation, they are generally used for E-book displays only. For a traditional LCD panel, whether it is in the static image displaying or dynamic image displaying, the refresh frequency of an IC is about 60 Hz or higher. If the image data being displayed is updated at a refresh frequency less than 60 Hz or higher or standby, IC power consumption can be reduced. Accordingly, the overall power consumption of the display penal can be lowered.

SARM memory has the advantages of low power consumption and high stability. However, the number of transistors is utilized, which sacrifices the aperture ratio of a pixel. For a high resolution display penal, it is very difficult to integrate the SARM memory in a pixel. DRAM memory has the advantages of small size and high integration. DRAM memory usually uses a capacitor to store data. Since a capacitor can not sustainably store charges therein, in order to keep the stored data, the data is usually refreshed by a driving IC, which results in high power consumption and poor stability.

Therefore, a heretofore unaddressed need exists in the art to address the aforementioned deficiencies and inadequacies.

SUMMARY OF THE INVENTION

One of the objectives of the present invention is to provide a pixel circuit integrating with a memory circuit that has the advantages of not only the automatic image refresh and low power consumption of an SRAM type circuit, but also the same size and high integration of a DRAM type memory circuit. It can be integrated in a high-resolution display panel. For such a display panel, when a display image is in a still mode, i.e., no refresh of the image, the display panel itself can use the memory circuit integrated in each pixel to automatic store and refresh the displayed image data. In the case, almost all of the IC of the display panel can be turned off. In addition, when the display image is refreshed at a low frequency, the IC of the display panel refreshes also at a lower frequency. Accordingly, power consumption of the display panel can be reduced dramatically.

In one aspect, the present invention relates to a memory circuit integrated in each pixel of a display device. Each pixel comprises a pixel switch, Pixel_SW, and a liquid crystal capacitor, Clc, electrically coupled to the pixel switch, Pixel_SW, and a storage capacitor, Cst, and operably alternates in a normal mode in which the pixel switch Pixel_SW is tuned on and a still mode in which the pixel switch Pixel_SW is tuned off. In one embodiment, the display device comprises a transflective display with each pixel having a transmissive area and a reflective area, wherein the memory circuit is formed under the reflective area, such that in the normal mode, the transmissive area transmits light from a backlight light source as a display light source, and in the still mode, the reflective area reflects external light as a display light source. In another embodiment, the display device comprises a reflective display.

In one embodiment, the memory circuit includes a switching circuit and a memory unit. The switching circuit includes a first transistor SW1 having a gate configured to receive a switching control signal, EN/EN_P, a source and a drain electrically coupled to the liquid crystal capacitor Clc, and a second transistor SW2 having a gate configured to receive a switching control signal, EN/EN_P, a source electrically coupled to the storage capacitor Cst, and a drain electrically coupled to the liquid crystal capacitor Clc. The memory unit is electrically coupled between the source of first transistor SW1 of the switching circuit and the storage capacitor Cst. The switching control signal EN/EN_P is configured such that in the normal mode, the first transistor SW1 is turned off, while the second transistor SW2 is turned on, so that the storage capacitor Cst is electrically coupled to the liquid crystal capacitor Clc in parallel and the memory unit is bypassed, and in the still mode, the first transistor SW1 is turned on, while the second transistor SW2 is turned off, so that the storage capacitor Cst controls the memory unit to supply a stored data to the liquid crystal capacitor Clc.

In one embodiment, the switching circuit further comprises a third transistor SW3 having a gate configured to receive the switching control signal, EN/EN_P, a source electrically coupled to the gate of the forth transistor SW4 and a drain electrically coupled to the storage capacitor Cst.

In one embodiment, one of the first and second transistors SW1 and SW2 is an n-type thin film transistor, and the other of the first and second transistors SW1 and SW2 is a p-type thin film transistor. The third transistor SW3 is the same type thin film transistor of the second transistor SW2.

In one embodiment, the memory unit includes a forth transistor SW4 having a gate electrically coupled to the storage capacitor Cst, a source configured to receive a first stored signal, Vw, and a drain electrically coupled to the source of the first transistor SW1, and a fifth transistor SW5 having a gate electrically coupled to the gate of the forth transistor SW4, a source configured to receive a second stored signal, Vb, and a drain electrically coupled to the drain of the forth transistor SW4, where one of the forth and fifth transistors SW4 and SW5 is an n-type thin film transistor, and the other of the forth and fifth transistors SW4 and SW5 is a p-type thin film transistor.

In another aspect, the present invention relates to a display device comprising a plurality of gate lines, a plurality of data lines, and a plurality of pixels spatially arranged in a matrix, each pixel formed between two neighboring gate lines and two neighboring data lines crossing the two neighboring gate lines.

Each pixel includes a pixel switch, Pixel_SW, having a gate electrically coupled to a corresponding gate line, a source electrically coupled to a corresponding data line, therefrom, and a drain, a liquid crystal capacitor, Clc, having a first terminal electrically coupled to the drain of the first transistor Pixel_SW, and a second terminal configured to receive a second common voltage, Vcom2, a storage capacitor, Cst, having a first terminal, and a second terminal configured to receive a first common voltage, Vcom1, and a memory circuit electrically coupled to between the first terminal of the liquid crystal capacitor Clc and the first terminal of the storage capacitor Cst.

In operation, a gate selection signal, GL, is supplied through the corresponding gate line to turn on the pixel switch Pixel_SW so that the pixel operates in a normal mode in which a data signal, DL, is supplied through the corresponding data line to the liquid crystal capacitor Clc and the memory circuit is bypassed between the first terminal of the liquid crystal capacitor Clc and the first terminal of the storage capacitor Cst, or to turn off the pixel switch Pixel_SW so that the pixel operates in a still mode in which the memory circuit supplies a corresponding stored data signal to the liquid crystal capacitor Clc.

The memory circuit comprises a switching circuit and a memory unit. The switching circuit includes a first transistor SW1 having a gate configured to receive a switching control signal, EN/EN_P, a source and a drain electrically coupled to the first terminal of the liquid crystal capacitor, Clc; and a second transistor SW2 having a gate configured to receive a switching control signal, EN/EN_P, a source electrically coupled to the first terminal of the storage capacitor Cst, and a drain electrically coupled to the first terminal of the liquid crystal capacitor Clc. The memory unit is electrically coupled between the source of first transistor SW1 of the first terminal of the switching circuit and the storage capacitor Cst, for supplying the corresponding stored data signal to the liquid crystal capacitor Clc, when operated in the still mode.

The memory unit comprises a forth transistor SW4 having a gate electrically coupled to the first terminal of the storage capacitor Cst, a source configured to receive a first stored signal, Vw, and a drain electrically coupled to the source of the first transistor SW1, and a fifth transistor SW5 having a gate electrically coupled to the gate of the forth transistor SW4, a source configured to receive a second stored signal, Vb, and a drain electrically coupled to the drain of the forth transistor SW4, where one of the forth and fifth transistors SW4 and SW5 is an n-type thin film transistor, and the other of the forth and fifth transistors SW4 and SW5 is a p-type thin film transistor.

In one embodiment, the first transistor SW1 is an n-type thin film transistor, and the second transistor SW2 is a p-type thin film transistor. The switching circuit further comprises a third transistor SW3 having a gate configured to receive the switching control signal, EN, a source electrically coupled to the gate of the forth transistor SW4, and a drain electrically coupled to the first terminal of the storage capacitor Cst, wherein the third transistor SW3 is an n-type thin film transistor. The switching control signal EN is in a low voltage level in the normal mode of operation, and in a high voltage level in the still mode of operation, respectively.

In another embodiment, the first transistor SW1 is a p-type thin film transistor, and the second transistor SW2 is an n-type thin film transistor. The memory circuit further comprises a third transistor SW3 having a gate configured to receive the switching control signal, EN_P, a source electrically coupled to the gate of the forth transistor SW4, and a drain electrically coupled to the first terminal of the storage capacitor Cst, wherein the second transistor SW is a p-type thin film transistor. The first control signal EN_P is in a high voltage level in the normal mode of operation, and in a low voltage level in the still mode of operation, respectively.

In one embodiment, in the normal mode of operation, the first and second common voltages Vcom1 and Vcom2 are AC signals having a frequency that is same as a refresh frequency, and in the still mode of operation, the first common voltage Vcom1 is a DC signal and the second common voltages Vcom2 is an AC signal having a frequency that is same as the refresh frequency.

In one embodiment, one of the first and second stored signals Vw and Vb is in-phase with the second common voltage Vcom2, and the other of the first and second stored signals Vw and Vb is out-phase with the second common voltage Vcom2.

In yet another aspect, the present invention relates to a method of driving the display device disclosed above. In one embodiment, the method includes providing the switching control signal configured such that in the normal mode, the first transistor SW1 is turned off, while the second transistor SW2 is turned on, so that the storage capacitor Cst is electrically coupled to the liquid crystal capacitor Clc in parallel and the memory unit is bypassed, and in the still mode, the first transistor SW1 is turned on, while the second transistor SW2 is turned off, so that the storage capacitor Cst controls the memory unit to supply a stored data to the liquid crystal capacitor Clc.

The method further includes providing the first and second common voltages Vcom1 and Vcom2 such that in the normal mode of operation, the first and second common voltages Vcom1 and Vcom2 are AC signals having a frequency that is same as a refresh frequency, and in the still mode of operation, the first common voltage Vcom1 is a DC signal and the second common voltages Vcom2 is an AC signal having a frequency that is same as the refresh frequency.

In addition, the method also includes providing one of the first and second stored signals Vw and Vb is in-phase with the second common voltage Vcom2, and the other of the second and third control signals Vw and Vb is out-phase with the second common voltage Vcom2.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
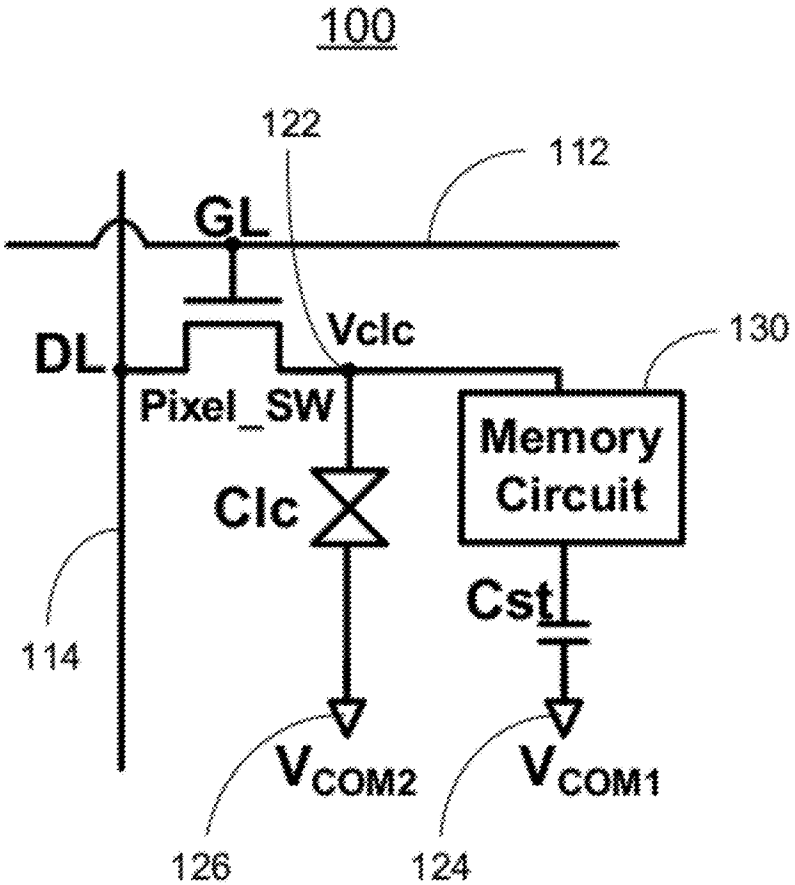
FIG. 1 shows schematically a circuit diagram of a pixel having a memory circuit according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to a memory circuit and a display device having the memory circuit integrated in each pixel of the display device.

The memory circuit integrates both DRAM and SRAM type circuit designs, and thus has the advantages of not only the automatic image refresh and low power consumption of an SRAM type circuit, but also the same size and high integration of a DRAM type circuit. The memory circuit has fewer TFTs and smaller layout area, and is very suitable for high-resolution display panels.

For a display panel integrating the memory circuit, it has a function of automatic refresh and store image data. When operating in a memory/still mode, i.e., no refresh of the image, the display panel itself can use the memory circuit integrated in each pixel to automatic store and refresh the displayed image data, and the IC of the display panel can refreshes at a very low frequency, e.g., less than 60 Hz, thereby reducing power consumption. In addition, the display panel can operably and freely switches between the normal mode and memory mode, so as to facilitate the variety of functions. Further, solar modules can be integrated with the display panel. Because of the low power consumption of the memory circuit, no external power may be consumed in the memory mode.

Referring to FIG. 1, a memory circuit 130 integrated in each pixel of a display device is shown according to one embodiment of the present invention. The display device has a plurality of gate lines 112, a plurality of data lines 114, and a plurality of pixels spatially arranged in a matrix. Each pixel is formed between two neighboring gate lines and two neighboring data lines crossing the two neighboring gate lines. For the purpose of illustration of the present invention, only one pixel 100 is shown in FIG. 1.

The pixel 100 includes a pixel switch, Pixel_SW, having a gate electrically coupled to a corresponding gate line 112 for receiving a gate selection signal, GL, therefrom, a source electrically coupled to a corresponding data line 114 for receiving an image data, DL, to be displayed therefrom, and a drain electrically coupled to a node 122. The node 122 is corresponding to a pixel electrode.

The pixel 100 also includes a liquid crystal capacitor, Clc, having a first terminal electrically coupled to the node 122 that is electrically coupled to the drain of the pixel switch Pixel_SW, and a second terminal electrically coupled to a node 126 for receiving a second common voltage, Vcom2, and a storage capacitor, Cst, having a first terminal, and a second terminal electrically coupled to a node 126 for receiving a first common voltage, Vcom1. The nodes 124 and 126 correspond to first and second common electrodes, respectively. The liquid crystal capacitor Clc is corresponding to a liquid crystal layer.

The pixel 100 further includes a memory circuit 130 electrically coupled to between the first terminal of the liquid crystal capacitor Clc and the first terminal of the storage capacitor Cst.

In operation, the gate selection signal GL is supplied through the corresponding gate line 112 to turn on or off the pixel switch Pixel_SW. When the pixel switch Pixel_SW is turned on, the pixel 100 operates in a normal mode in which the image data signal DL is supplied through the corresponding data line 114 to the liquid crystal capacitor Clc and the memory circuit 120 is bypassed between the first terminal of the liquid crystal capacitor Clc and the first terminal of the storage capacitor Cst. In the normal mode of operation, the pixel electrode 122, i.e. the first terminal of the liquid crystal capacitor Clc and the first terminal of the storage capacitor Cst are charged to a voltage Vclc by to the image data signal DL, in other words, the image data signal is written in the pixel 100 for display. When the pixel switch Pixel_SW is turned off, the pixel 100 operates in a still mode in which the memory circuit 120 supplies a corresponding stored data signal to the liquid crystal capacitor Clc, which is controlled by the voltage of the first terminal of the storage capacitor Cst. In the case, the displayed image can be refreshed according to the stored data signal.

In the normal mode of operation, the first and second common voltages Vcom1 and Vcom2 are AC signals having a frequency that is same as a refresh frequency. In the still mode of operation, the first common voltage Vcom1 is a DC signal and the second common voltagesVcom2 is an AC signal having a frequency that is same as the refresh frequency.

Figure 2:
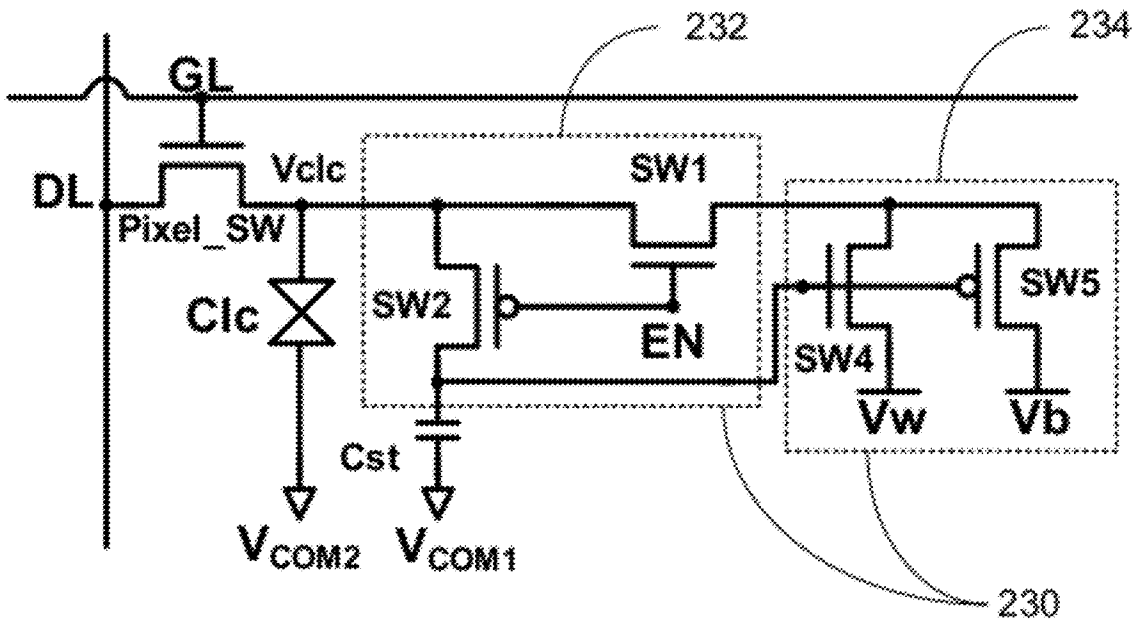
FIG. 2 shows schematically a circuit diagram of a pixel having a memory circuit according to another embodiment of the present invention.

Specifically, as shown in FIG. 2, in one embodiment, the memory circuit 230 has a switching circuit 232 and a memory unit 234. The switching circuit 232 includes a first transistor SW1 and a second transistor SW2. The first transistor SW1 has a gate configured to receive a switching control signal, EN, a source and a drain electrically coupled to the first terminal of the liquid crystal capacitor Clc. The second transistor SW2 has a gate configured to receive the switching control signal, EN, a source electrically coupled to the first terminal of the storage capacitor Cst, and a drain electrically coupled to the first terminal of the liquid crystal capacitor Clc. The first transistor SW1 is an n-type thin film transistor, and the second transistor SW2 is a p-type thin film transistor.

The memory unit 232 includes a forth transistor SW4 and a fifth transistor SW5. The forth transistor SW4 has a gate electrically coupled to the first terminal of the storage capacitor Cst, a source configured to receive a first stored signal, Vw, and a drain electrically coupled to the source of the first transistor SW1. The fifth transistor SW5 has a gate electrically coupled to the gate of the forth transistor SW4, a source configured to receive a second stored signal, Vb, and a drain electrically coupled to the drain of the forth transistor SW4. The forth transistor SW4 is an n-type thin film transistor or a p-type thin film transistor, while the fifth transistor SW5 is the p-type thin film transistor or the n-type thin film transistor. The first and second stored signals Vw and Vb have a frequency same as that of the second common voltage Vcom2. Further, one of the first and second stored signals Vw and Vb is in-phase with the second common voltage Vcom2, and the other of the first and second stored signals Vw and Vb is out-phase with the second common voltage Vcom2.

Figure 3:
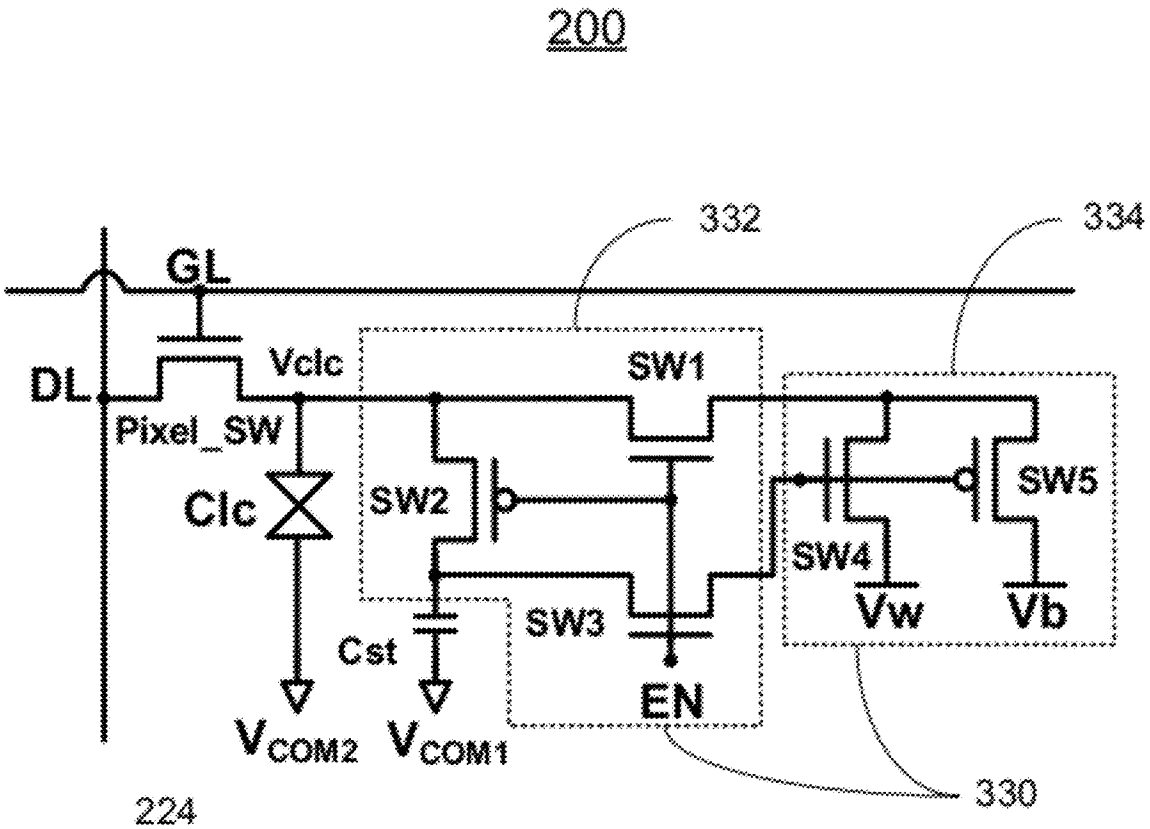
FIG. 3 shows schematically a circuit diagram of a pixel having a memory circuit according to yet another embodiment of the present invention.

As shown in FIG. 3, in another embodiment, the memory circuit 330 has a switching circuit 332 and a memory unit 334. The memory unit 334 is identical to the memory unit 234 of FIG. 2. In addition to the first transistor SW1 and the second transistor SW2 of the switching circuit 232 of FIG. 2, the switching circuit 332 further includes a third transistor SW3 having a gate configured to receive the switching control signal, EN, a source electrically coupled to the gate of the forth transistor SW4, and a drain electrically coupled to the first terminal of the storage capacitor Cst. The third transistor SW3 is an n-type thin film transistor.

The switching control signal EN is configured to be in a low voltage level in the normal mode of operation, and in a high voltage level in the still mode of operation, respectively. In the normal mode of operation, the second transistor SW2 is turned on, while the first transistor SW1 and the third transistor SW3 are turned off. Accordingly, the memory circuit 230/330 is bypassed and the first terminals of the liquid crystal capacitor Clc and the storage capacitor Cst are electrically connected to the pixel electrode that is charged to the voltage Vclc by the image data DL. In the memory/still mode of operation, the second transistor SW2 is turned off, while the first transistor SW1 and the third transistor SW3 are turned on. Accordingly, one of the forth transistor SW4 and the fifth transistor SW5 is turned on by the voltage potential charged at the first terminal of the storage capacitor Cst, whereby a corresponding one of the first and second stored signals Vw and Vb is supplied through the first transistor SW1 to the pixel electrode, i.e., the first terminal of the liquid crystal capacitor Clc, thereby displaying the stored image data.

Figure 4:
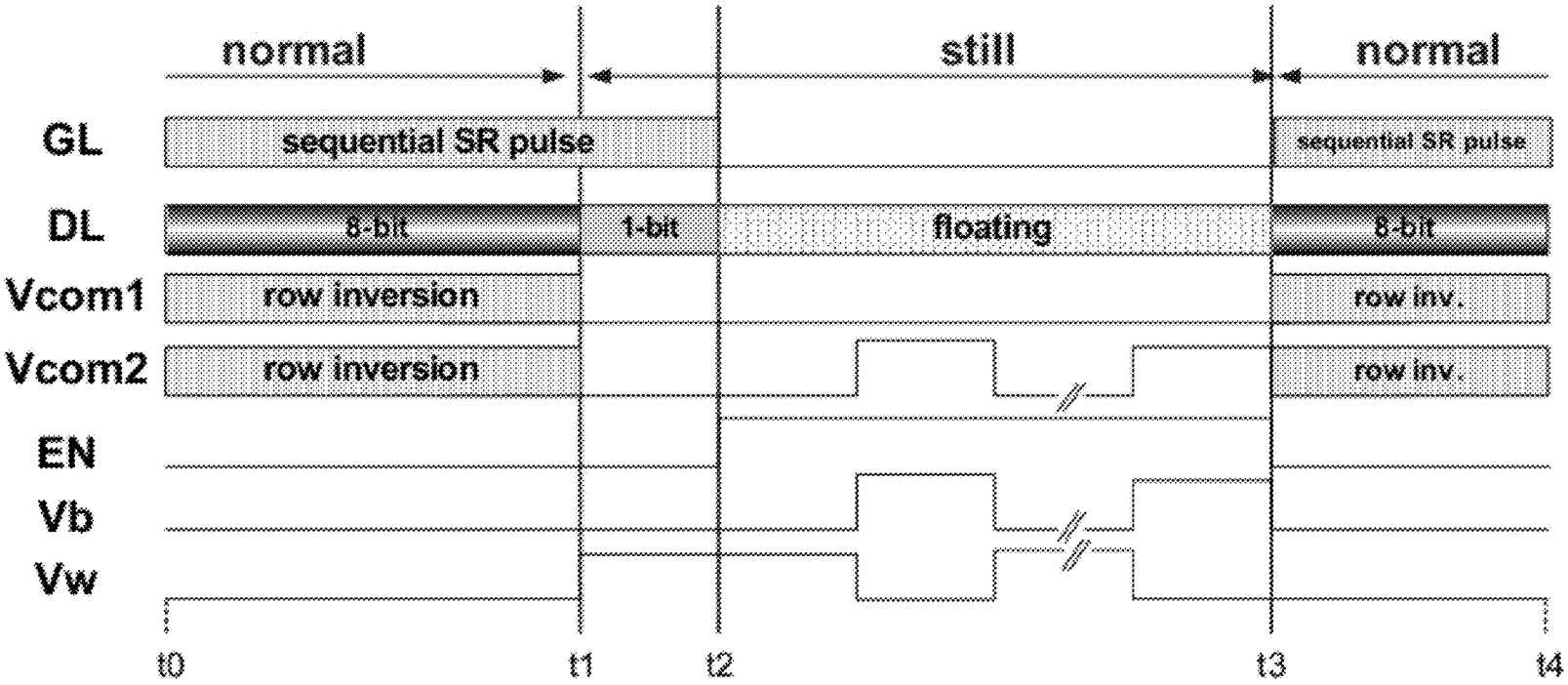
FIG. 4 shows schematically timing charts of a pixel having a memory circuit according to one embodiment of the present invention.

Referring to FIG. 4, time charts of signals of the pixel memory circuit of FIGS. 2 and 3 are shown.

In the normal mode of operation, i.e., the time period of (t1–t0), the gate selection signal GL, which is a sequential SR pulse signal, turns on the pixel switch Pixel_SW. The switching control signal EN is in the low voltage level, which turns the second transistor SW2 on, and the first transistor SW1 and the third transistor SW3 off, respectively. The memory circuit 230/330 is bypassed and the first terminals of the liquid crystal capacitor Clc and the storage capacitor Cst are electrically connected to the pixel electrode. Accordingly, the image data DL (8 bit or more) is written in the storage capacitor Cst. In the normal mode of operation, the first and second stored signals Vw and Vb has no effect on the voltage Vclc of the pixel electrode. The first and second stored signals Vw and Vb can be in a low voltage level. The first and second common voltages Vcom1 and Vcom2 are corresponding to a traditional line, frame or dot inversion signals.

When the operation enters into the memory/still mode, for example, in the time period of (t2–t1), a 1 bit data is written in the first frame. In the time period, the switching control signal EN is in the low voltage level. The second transistor SW2 is turned on, while the first transistor SW1 and the third transistor SW3 are turned off. The pixel switch Pixel_SW is turned on by the sequential SR pulse signal GL, and the image data (1 bit) is written in the storage capacitor Cst. The first stored signal Vw changes to a high voltage level of the next frame, while the second stored signal Vb is still in the low voltage level in the next frame. The first common voltage Vcom1 is a DC signal, while the second common voltage Vcom2 is corresponding to a traditional line, frame or dot inversion signals.

In the time period of (t3–t2), the second frame fully enters into the still mode of operation, the IC of the display provides the first and second common voltages Vcom1 and Vcom2, the first and second stored data Vw and Vb and the switch control signal EN only, the other functions of the IC can be turned off. In the time period, the switch control signal EN is in the high voltage level, which turns the second transistor SW2 off, and the first transistor SW1 and the third transistor SW3 on, respectively. GL and DL are DC signals or floating. The first and second stored data Vw and Vb alternately changes the voltage levels between high and low levels according to the frequency of the second common voltage Vcom1. The value of the frequency depends from the refresh time of the display. The second common voltage Vcom2 is corresponding to a traditional line, frame or dot inversion signals.

In the time period of (t4–t3), the operation enters into the normal mode. The gate selection signal GL, which is a sequential SR pulse signal, turns on the pixel switch Pixel_SW. The switching control signal EN is in the low voltage level, which turns the second transistor SW2 on, and the first transistor SW1 and the third transistor SW3 off, respectively. The memory circuit 230/330 is bypassed and the first terminals of the liquid crystal capacitor Clc and the storage capacitor Cst are electrically connected to the pixel electrode. Accordingly, the image data DL (8 bit or more) is written in the storage capacitor Cst. In the normal mode of operation, the first and second stored signals Vw and Vb has no effect on the voltage Vclc of the pixel electrode. The first and second stored signals Vw and Vb can be in a low voltage level. The first and second common voltages Vcom1 and Vcom2 are corresponding to a traditional line, frame or dot inversion signals.

The above processes are repeated for displaying the image data.

Figure 5:
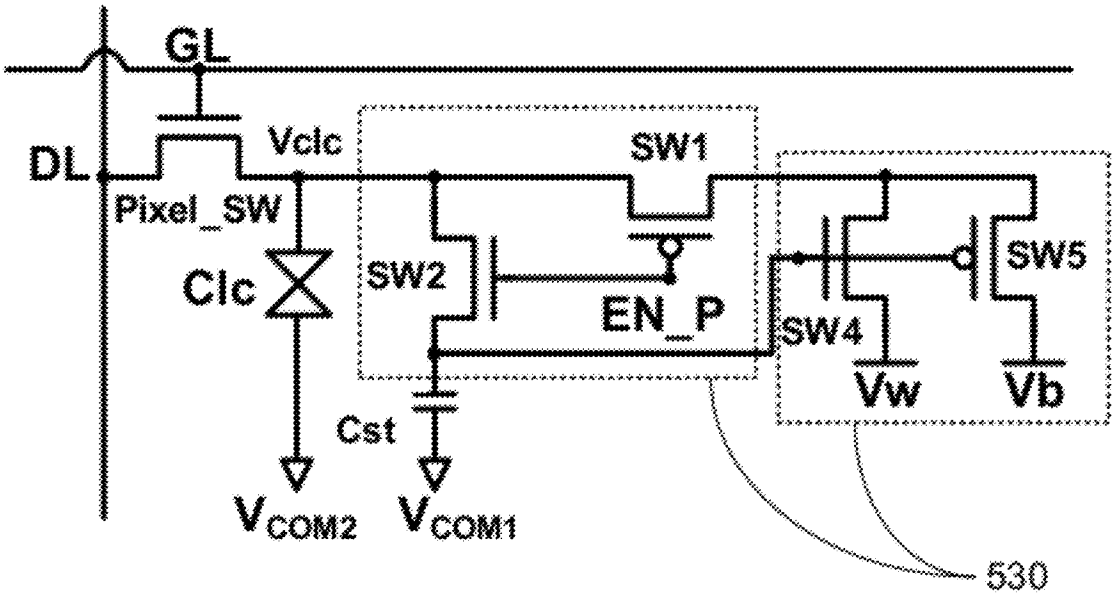
FIG. 5 shows schematically a circuit diagram of a pixel having a memory circuit according to another embodiment of the present invention.
Figure 6:
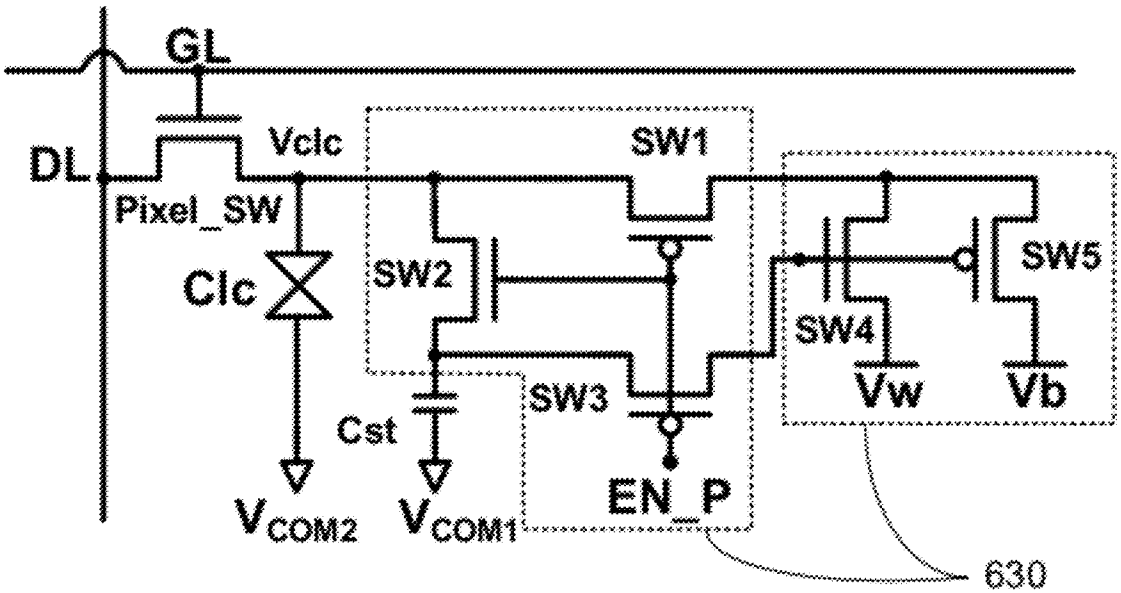
FIG. 6 shows schematically a circuit diagram of a pixel having a memory circuit according to yet another embodiment of the present invention.

FIGS. 5 and 6 show another two embodiments of the memory circuit 530/630, which are structurally same as the memory circuit 230/330 of FIGS. 2 and 3, respectively, except that the first and third transistors SW1 and SW3 are a p-type thin film transistor, while the second transistor SW2 is an n-type thin film transistor. The switching control signal EN_P is configured to be in a high voltage level in the normal mode of operation, and in a low voltage level in the still mode of operation, respectively.

Figure 7:
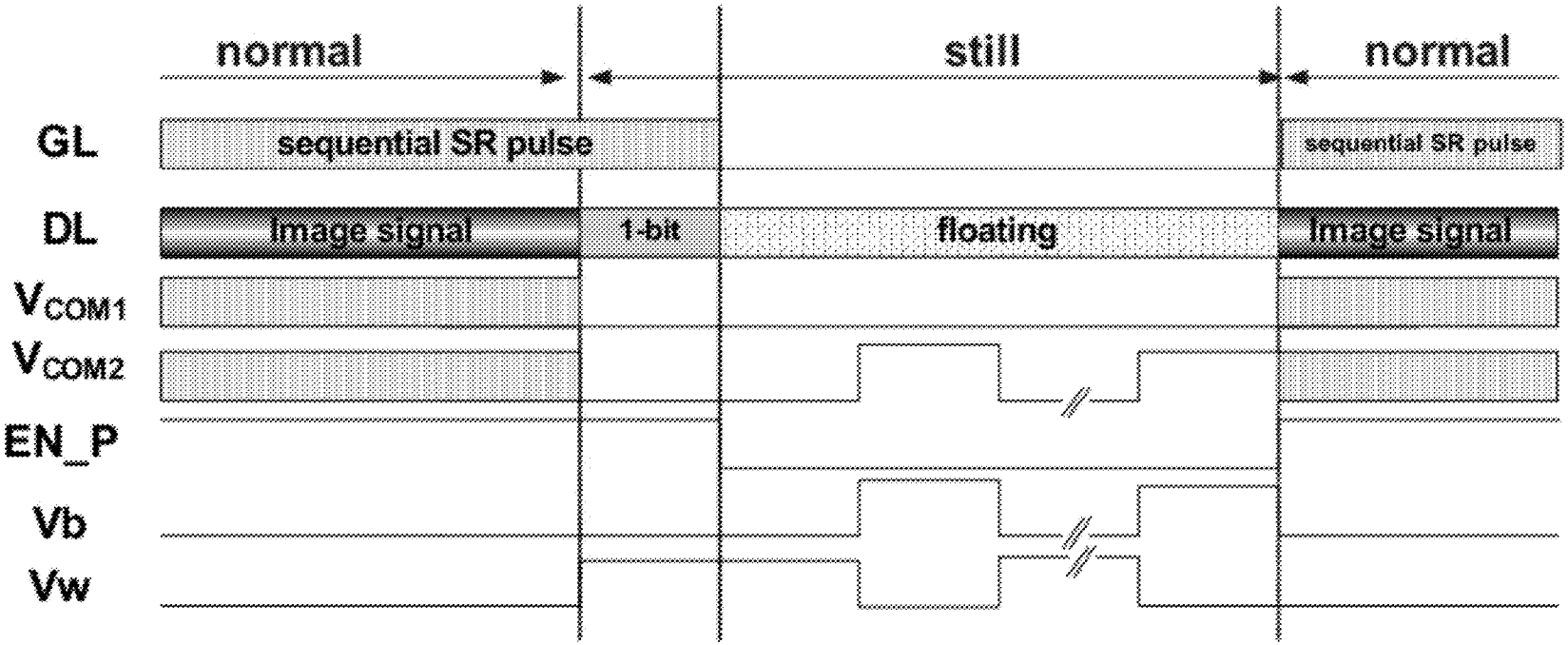
FIG. 7 shows schematically timing charts of a pixel having a memory circuit according to one embodiment of the present invention.

FIG. 7 shows the time charts of signals of the pixel memory circuit of FIGS. 5 and 6, which are similar to the time charts shown in FIG. 4. In the normal mode of operation, the second transistor SW2 is turned on, while the first transistor SW1 and the third transistor SW3 are turned off. Accordingly, the memory circuit 530/630 is bypassed and the first terminals of the liquid crystal capacitor Clc and the storage capacitor Cst are electrically connected to the pixel electrode that is charged to the voltage Vclc by the image data DL. In the memory/still mode of operation, the second transistor SW2 is turned off, while the first transistor SW1 and the third transistor SW3 are turned on. Accordingly, one of the forth transistor SW4 and the fifth transistor SW5 is turned on by the voltage potential charged at the first terminal of the storage capacitor Cst, whereby a corresponding one of the first and second stored signals Vw and Vb is supplied through the first transistor SW1 to the pixel electrode, i.e., the first terminal of the liquid crystal capacitor Clc, thereby displaying the stored image data.

According to the present invention, the display device can be a transflective display with each pixel having a transmissive area and a reflective area. The memory circuit can be formed under the reflective area, such that in the normal mode, the transmissive area transmits light from a backlight light source as a display light source, and in the still mode, the reflective area reflects external light as a display light source. The display device may include a reflective display.

In one aspect, the present invention relates to a method of driving the display device disclosed above. The method, in one embodiment, includes providing the switching control signal EN/EN_P configured such that in the normal mode, the first transistor SW1 is turned off, while the second transistor SW2 is turned on, so that the storage capacitor Cst is electrically coupled to the liquid crystal capacitor Clc in parallel and the memory unit is bypassed, and in the still mode, the first transistor SW1 is turned on, while the second transistor SW2 is turned off, so that the storage capacitor Cst controls the memory unit to supply a stored data to the liquid crystal capacitor Clc.

The method further includes providing the first and second common voltages Vcom1 and Vcom2 such that in the normal mode of operation, the first and second common voltages Vcom1 and Vcom2 are AC signals having a frequency that is same as a refresh frequency, and in the still mode of operation, the first common voltage Vcom1 is a DC signal and the second common voltagesVcom2 is an AC signal having a frequency that is same as the refresh frequency.

In addition, the method also includes providing one of the first and second stored signals Vw and Vb is in-phase with the second common voltage Vcom2, and the other of the second and third control signals Vw and Vb is out-phase with the second common voltage Vcom2.

In sum, the present invention, among other tings, recites a memory circuit and a display device having each pixel integrating with the memory circuit, which operates in the normal mode or in the memory/still mode. In the normal mode of operation, the memory circuit bypasses other components, the pixel is same as a traditional pixel, that is, the pixel switch Pixel_SW is turned on and the storage capacitor Cst maintains the voltage potential Vclc, thereby controlling the liquid crystal capacitor Clc. In the memory mode of operation, the memory circuit supplies a corresponding stored data signal to the liquid crystal capacitor Clc, which is controlled by the voltage of the storage capacitor Cst. In the case, the displayed image can be refreshed according to the stored data signal, and most of the IC outputs can be turned off. Accordingly, the power consumption can be lowered substantially.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A memory circuit integrated in each pixel of a display device, wherein each pixel comprises a pixel switch, Pixel_SW, and a liquid crystal capacitor, Clc, electrically coupled to the pixel switch, Pixel_SW, and a storage capacitor, Cst, and operably alternates in a normal mode in which the pixel switch Pixel_SW is tuned on and a still mode in which the pixel switch Pixel_SW is tuned off, comprising:

(a) a switching circuit comprising:

a first transistor, SW1, having a gate configured to receive a switching control signal, EN/EN_P, a source and a drain electrically coupled to the liquid crystal capacitor Clc;

a second transistor, SW2, having a gate configured to receive a switching control signal, EN/EN_P, a source electrically coupled to the storage capacitor Cst, and a drain electrically coupled to the liquid crystal capacitor Clc; and a third transistor, SW3, having a gate configured to receive the switching control signal, EN/EN_P, a source and a drain electrically coupled to the storage capacitor Cst; and (b) a memory unit electrically coupled between the source of first transistor SW1 and the source of the third transistor SW3 of the switching circuit, wherein the switching control signal EN/EN_P is configured such that in the normal mode, the first transistor SW1 and the third transistor SW3 are turned off, while the second transistor SW2 is turned on, so that the storage capacitor Cst is electrically coupled to the liquid crystal capacitor Clc in parallel and the memory unit is bypassed, and in the still mode, the first transistor SW1 and the third transistor SW3 are turned on, while the second transistor SW2 is turned off, so that the storage capacitor Cst controls the memory unit to supply a stored data to the liquid crystal capacitor Clc.

2. The memory circuit of claim 1, wherein the memory unit comprises:

(a) a fourth transistor, SW4, having a gate electrically coupled to the source of the third transistor SW3 of the switching circuit, a source configured to receive a first stored signal, Vw, and a drain electrically coupled to the source of the first transistor SW1; and (b) a fifth transistor, SW5, having a gate electrically coupled to the gate of the fourth transistor SW4, a source configured to receive a second stored signal, Vb, and a drain electrically coupled to the drain of the fourth transistor SW4.

3. The memory circuit of claim 2, wherein one of the fourth and fifth transistors SW4 and SW5 is an n-type thin film transistor, and the other of the fourth and fifth transistors SW4 and SW5 is a p-type thin film transistor.

4. The memory circuit of claim 2, wherein one of the first and second transistors SW1 and SW2 is an n-type thin film transistor, and the other of the first and second transistors SW1 and SW2 is a p-type thin film transistor.

5. The memory circuit of claim 1, wherein the third transistor SW3 is the same type thin film transistor of the first transistor SW1.

6. The memory circuit of claim 1, wherein the display device comprises a transflective display with each pixel having a transmissive area and a reflective area, wherein the memory circuit is formed under the reflective area, such that in the normal mode, the transmissive area transmits light from a backlight light source as a display light source, and in the still mode, the reflective area reflects external light as a display light source.

7. The memory circuit of claim 1, wherein the display device comprises a reflective display.

8. A display device, comprising a plurality of gate lines, a plurality of data lines, and a plurality of pixels spatially arranged in a matrix, each pixel formed between two neighboring gate lines and two neighboring data lines crossing the two neighboring gate lines, each pixel comprising:

(a) a pixel switch, Pixel_SW, having a gate electrically coupled to a corresponding gate line, a source electrically coupled to a corresponding data line, and a drain;

(b) a liquid crystal capacitor, Clc, having a first terminal electrically coupled to the drain of the first transistor Pixel_SW, and a second terminal configured to receive a second common voltage, Vcom2;

(c) a storage capacitor, Cst, having a first terminal, and a second terminal configured to receive a first common voltage, Vcom1; and (d) a memory circuit electrically coupled to between the first terminal of the liquid crystal capacitor Clc and the first terminal of the storage capacitor Cst, comprising:

(i) a switching circuit comprising:

a first transistor, SW1, having a gate configured to receive a switching control signal, EN/EN_P, a source and a drain electrically coupled to the liquid crystal capacitor Clc;

a second transistor, SW2, having a gate configured to receive a switching control signal, EN/EN_P, a source electrically coupled to the storage capacitor Cst, and a drain electrically coupled to the liquid crystal capacitor Clc; and a third transistor, SW3, having a gate configured to receive the switching control signal, EN/EN_P, a source and a drain electrically coupled to the storage capacitor Cst; and (ii) a memory unit electrically coupled between the source of first transistor SW1 and the source of the third transistor SW3 of the switching circuit, wherein the switching control signal EN/EN_P is configured such that in a normal mode, the first transistor SW1 and the third transistor SW3 are turned off, while the second transistor SW2 is turned on, so that the storage capacitor Cst is electrically coupled to the liquid crystal capacitor Clc in parallel and the memory unit is bypassed, and in a still mode, the first transistor SW1 and the third transistor SW3 are turned on, while the second transistor SW2 is turned off, so that the storage capacitor Cst controls the memory unit to supply a stored data to the liquid crystal capacitor Clc, wherein in operation, a gate selection signal, GL, is supplied through the corresponding gate line to turn on the pixel switch Pixel_SW so that the pixel operates in the normal mode in which a data signal, DL, is supplied through the corresponding data line to the liquid crystal capacitor Clc and the memory circuit is bypassed between the first terminal of the liquid crystal capacitor Clc and the first terminal of the storage capacitor Cst, or to turn off the pixel switch Pixel_SW so that the pixel operates in the still mode in which the memory circuit supplies a corresponding stored data signal to the liquid crystal capacitor Clc.

9. The display device of claim 8, wherein the memory unit comprises:

(a) a fourth transistor, SW4, having a gate electrically coupled to the source of the third transistor SW3 of the switching circuit, a source configured to receive a first stored signal, Vw, and a drain electrically coupled to the source of the first transistor SW1; and (b) a fifth transistor, SW5, having a gate electrically coupled to the gate of the fourth transistor SW4, a source configured to receive a second stored signal, Vb, and a drain electrically coupled to the drain of the fourth transistor SW4.

10. The display device of claim 9, wherein one of the fourth and fifth transistors SW4 and SW5 is an n-type thin film transistor, and the other of the fourth and fifth transistors SW4 and SW5 is a p-type thin film transistor.

11. The display device of claim 9, wherein the first transistor SW1 is an n-type thin film transistor, and the second transistor SW2 is a p-type thin film transistor.

12. The display device of claim 11, wherein the third transistor SW3 is an n-type thin film transistor.

13. The display device of claim 12, wherein the switching control signal EN is in a low voltage level in the normal mode of operation, and in a high voltage level in the still mode of operation, respectively.

14. The display device of claim 9, wherein the first transistor SW1 is a p-type thin film transistor, and the second transistor SW2 is an n-type thin film transistor.

15. The display device of claim 14, wherein the third transistor SW3 is a p-type thin film transistor.

16. The display device of claim 15, wherein the first control signal EN_P is in a high voltage level in the normal mode of operation, and in a low voltage level in the still mode of operation, respectively.

17. The display device of claim 9, wherein in the normal mode of operation, the first and second common voltages Vcom1 and Vcom2 are AC signals having a frequency that is same as a refresh frequency, and in the still mode of operation, the first common voltage Vcom1 is a DC signal and the second common voltagesVcom2 is an AC signal having a frequency that is same as the refresh frequency.

18. The display device of claim 17, wherein in the still mode of operation, one of the first and second stored signals Vw and Vb is in-phase with the second common voltage Vcom2, and the other of the first and second stored signals Vw and Vb is out-phase with the second common voltage Vcom2.

19. A method of driving the display device of claim 9, comprising:

providing the switching control signal configured such that in the normal mode, the first transistor SW1 and the third transistor SW3 are turned off, while the second transistor SW2 is turned on, so that the storage capacitor Cst is electrically coupled to the liquid crystal capacitor Clc in parallel and the memory unit is bypassed, and in the still mode, the first transistor SW1 and the third transistor SW3 are turned on, while the second transistor SW2 is turned off, so that the storage capacitor Cst controls the memory unit to supply a stored data to the liquid crystal capacitor Clc.

20. The method of claim 19, further comprising:

providing the first and second common voltages Vcom1 and Vcom2 such that in the normal mode of operation, the first and second common voltages Vcom1 and Vcom2 are AC signals having a frequency that is same as a refresh frequency, and in the still mode of operation, the first common voltage Vcom1 is a DC signal and the second common voltages Vcom2 is an AC signal having a frequency that is same as the refresh frequency.

21. The method of claim 20, further comprising:

providing one of the first and second stored signals Vw and Vb is in-phase with the second common voltage Vcom2, and the other of the second and third control signals Vw and Vb is out-phase with the second common voltage Vcom2.

* * * * *